US009422715B1

(12) United States Patent
Selzer

(10) Patent No.: US 9,422,715 B1
(45) Date of Patent: Aug. 23, 2016

(54) LOUVERED ROOF APPARATUS AND CONTROL SYSTEM

(71) Applicant: C. Scott Selzer, Cumming, GA (US)

(72) Inventor: C. Scott Selzer, Cumming, GA (US)

( * ) Notice: Subject to any disclaimer, the term of this patent is extended or adjusted under 35 U.S.C. 154(b) by 0 days.

(21) Appl. No.: 14/588,786

(22) Filed: Jan. 2, 2015

Related U.S. Application Data

(63) Continuation-in-part of application No. 13/873,730, filed on Apr. 30, 2013, now abandoned.

(60) Provisional application No. 61/640,839, filed on May 1, 2012.

(51) Int. Cl.

| | |
|---|---|
| ***E04B 7/16*** | (2006.01) |
| ***E04D 11/00*** | (2006.01) |
| ***E04D 13/035*** | (2006.01) |
| ***E04D 13/17*** | (2006.01) |
| ***E04F 10/08*** | (2006.01) |

(52) U.S. Cl.
CPC ..... *E04B 7/163* (2013.01); *E04D 11/00* (2013.01); *E04D 13/0354* (2013.01); *E04D 13/17* (2013.01); *E04F 10/08* (2013.01)

(58) Field of Classification Search
CPC ..... E04B 7/163; E04B 7/166; F24F 13/15; E04F 10/08; E04F 10/10; E06B 7/084; E06B 7/86; E04D 13/0354; E04D 13/17
USPC ..... 49/74.1, 82.1, 87.1, 90.1, 91.1, 92.1, 49/139
See application file for complete search history.

(56) References Cited

U.S. PATENT DOCUMENTS 1,519,553 A * 12/1924 Riker ..... E06B 7/084 109/16
2,068,148 A * 1/1937 Moir ..... E04F 10/10 160/165
2,187,639 A * 1/1940 Bond ..... E04F 10/10 160/61
2,210,869 A * 8/1940 Larson ..... F24F 13/15 49/74.1
2,281,071 A * 4/1942 Knudsen ..... E06B 7/084 160/107
2,291,714 A * 8/1942 Heiser ..... E04F 10/10 49/77.1
2,296,467 A * 9/1942 Dugan ..... E04F 10/10 160/61
2,592,579 A * 4/1952 Kramer ..... E04F 10/10 49/71
2,629,145 A * 2/1953 Parsson ..... E04F 10/10 49/397
2,758,834 A * 8/1956 Sanford ..... E06B 7/084 49/140
2,791,009 A * 5/1957 Wagner ..... E04F 10/10 49/77.1
2,822,587 A * 2/1958 Hallock ..... E06B 7/084 49/403
2,857,634 A * 10/1958 Garbade ..... E04B 7/163 119/437
2,952,049 A * 9/1960 Vetere ..... E04F 10/10 49/403
3,011,225 A * 12/1961 Alfred ..... E04F 10/10 49/74.1
3,123,189 A * 3/1964 Wiley ..... E06B 7/084 454/224
3,161,268 A * 12/1964 Bent ..... E06B 7/084 49/403
3,196,895 A * 7/1965 Dayus ..... F24F 13/15 137/270
3,346,007 A * 10/1967 Agnon ..... F24F 11/043 137/512.1
3,571,973 A * 3/1971 Roberts ..... E06B 7/084 160/6
3,591,980 A * 7/1971 Cheng ..... E06B 7/084 49/403
3,741,102 A * 6/1973 Kaiser ..... F24F 13/10 454/319

(Continued)

*Primary Examiner* — Justin Rephann
(74) *Attorney, Agent, or Firm* — P. Jeff Martin; The Law Firm of P. Jeffrey Martin, LLC

(57) ABSTRACT

A louvered roof assembly includes a support frame and several panels mounted between the support frame. The panels are pivotally coupled to the support frame for rotation about an axis. Each of the panels has a first end and a second end. A linear drive mechanism is coupled to each of the panels. The linear drive mechanism is mounted within at least one of the beams of the support frame and includes an actuator arm mounted to one of the support members.

9 Claims, 20 Drawing Sheets

(56) References Cited

U.S. PATENT DOCUMENTS 3,884,414 A * 5/1975 Baer ..... E06B 7/084 126/585
3,982,355 A * 9/1976 Piercey ..... E04F 10/08 248/222.12
4,038,781 A * 8/1977 Graham ..... E06B 7/084 454/224
4,099,346 A * 7/1978 Isono ..... E04B 7/163 160/236
4,186,531 A * 2/1980 Okolischan ..... E04D 13/15 52/11
4,283,900 A * 8/1981 Schubert ..... E04B 1/2604 403/402
4,527,355 A 7/1985 Numakami et al.
4,869,380 A * 9/1989 Metcalfe ..... H05K 7/183 211/189
4,926,599 A * 5/1990 Scholz ..... E04F 10/08 49/87.1
5,035,091 A * 7/1991 Ebato ..... A01G 9/242 160/265
5,306,210 A * 4/1994 Smit ..... E04B 7/163 454/250
5,440,844 A * 8/1995 Chihara ..... E04B 1/2403 211/191
5,566,738 A * 10/1996 Yadidya ..... E06B 9/165 160/133
5,655,335 A * 8/1997 Vermeer ..... A01G 9/14 47/17
5,669,179 A 9/1997 Hanlon
5,732,507 A * 3/1998 Edwards ..... E04B 7/163 49/74.1
5,839,233 A * 11/1998 Smit ..... E06B 7/086 454/250
5,862,633 A * 1/1999 Van Ells ..... E03B 3/02 135/117
5,873,202 A * 2/1999 Parks ..... E04F 10/08 49/74.1
6,202,363 B1 * 3/2001 Chang ..... E04B 7/163 160/22
7,076,921 B2 * 7/2006 Spradlin ..... E04D 13/0641 248/48.1
8,413,389 B2 * 4/2013 Frigerio ..... E04F 10/08 52/302.1
8,413,705 B2 * 4/2013 Castel ..... E04B 7/163 160/107
8,756,873 B1 * 6/2014 Hire ..... E04F 10/10 49/74.1
8,763,310 B2 * 7/2014 Dehart, Sr. ..... E04D 13/0643 52/11
2004/0148899 A1 * 8/2004 Pertile ..... E06B 7/086 52/581
2006/0040607 A1 * 2/2006 Perez ..... E04B 7/163 454/358
2008/0134589 A1 * 6/2008 Abrams ..... E04B 1/003 52/79.1
2011/0314758 A1 * 12/2011 Mora ..... E04D 13/17 52/302.1
2014/0130988 A1 * 5/2014 Frigerio ..... E04F 10/10 160/138

* cited by examiner

LOUVERED ROOF APPARATUS AND CONTROL SYSTEM

I. RELATED APPLICATIONS

The present application is a Continuation-in-Part of application Ser. No. 13/873,730, filed on Apr. 30, 2013, which claims the benefit of priority to U.S. Provisional Application No. 61/640,839, filed on May 1, 2012. The entire contents of said related applications are incorporated herein by reference.

II. TECHNICAL FIELD OF THE INVENTION

This invention relates to the control and configuration of a louvered roof with a series of louvers controlled by a linear drive mechanism.

III. BACKGROUND OF THE INVENTION

Conventionally, louvered roof assemblies generally include a plurality of parallel louvers which are pivotally supported on a frame above a patio or portion of a home. The louvered roof assemblies are adjustable and may be opened or closed from a motor operated by a battery and/or person.

There are numerous deficiencies with louvered roof assemblies that exist today. For example, the louvered roof panels are not configured to close directly onto one another. Another shortcoming is the design of the motors and actuators which move to open and close the panels. Conventional designs fail to offer reasonable maintenance options leaving the owner of such assemblies without a reasonable remedy to correct problems which arise unexpectedly. Another known deficiency is the overlapping surface area of the motor assembly being located within the water flow area of a corresponding assembly gutter. Such a configuration may result in water damage to the motor and a short to any corresponding electrical connectors.

IV. SUMMARY OF THE INVENTION

Example embodiments provide a water resistant and optimized louvered roof system that opens and closes securely and efficiently. The motorized linear drive system ensures durability and long-lasting success to the owner of such a roof system.

According to one embodiment of the present invention, a louvered roof assembly includes a pair of support members and several panels mounted between the support members. The panels are pivotally coupled to the support members for rotation about an axis by corresponding pivot pins. Each of the panels has a first end and a second end. One of the pivot pins is coupled to each end of the panels. A linear drive mechanism is coupled to each of the panels. The linear drive mechanism includes a track bar coupled to each of the panels and an actuator mounted to one of the support members and coupled to the track bar. The actuator is configured to move the track bar such that the panels rotate about the axis of their respective pivot pins.

V. BRIEF DESCRIPTION OF THE DRAWINGS

VI. DETAILED DESCRIPTION OF THE INVENTION

It will be readily understood that the components of the present invention, as generally described and illustrated in the figures herein, may be arranged and designed in a wide variety of different configurations. Thus, the following detailed description of the embodiments as represented in the attached figures, is not intended to limit the scope of the invention as claimed, but is merely representative of selected embodiments of the invention.

The features, structures, or characteristics of the invention described throughout this specification may be combined in any suitable manner in one or more embodiments. For example, the usage of the phrases "example embodiments", "some embodiments", or other similar language, throughout this specification refers to the fact that a particular feature, structure, or characteristic described in connection with the embodiment may be included in at least one embodiment of the present invention. Thus, appearances of the phrases "example embodiments", "in some embodiments", "in other embodiments", or other similar language, throughout this specification do not necessarily all refer to the same group of embodiments, and the described features, structures, or characteristics may be combined in any suitable manner in one or more embodiments.

Figure 1:
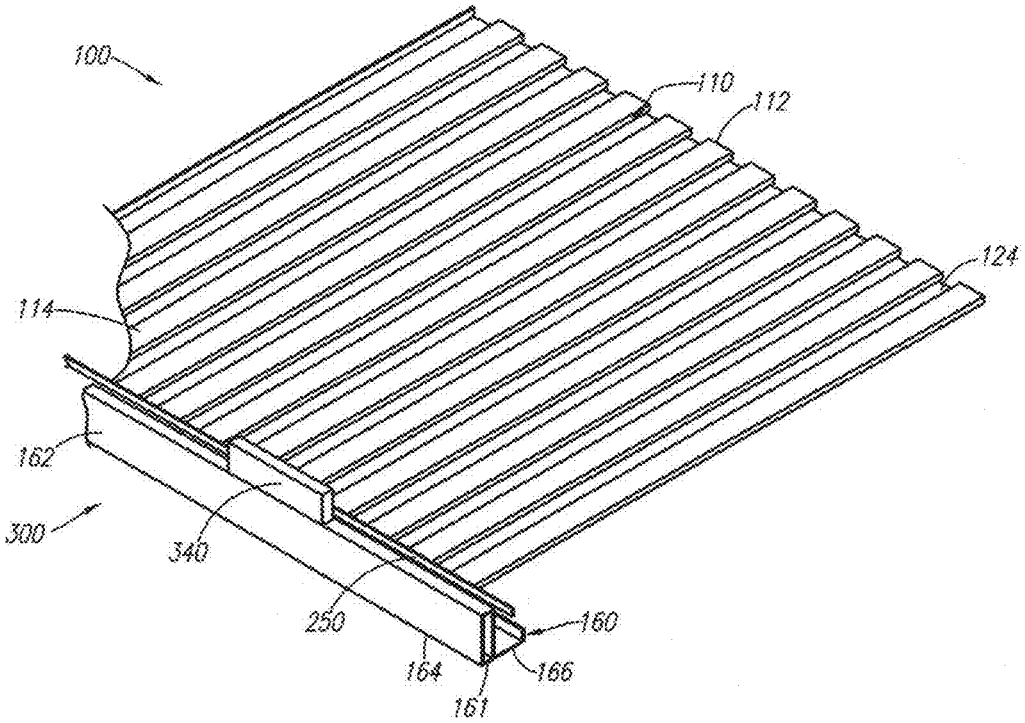
FIG. 1 illustrates a louvered roof assembly, according to example embodiments.
Figure 4:
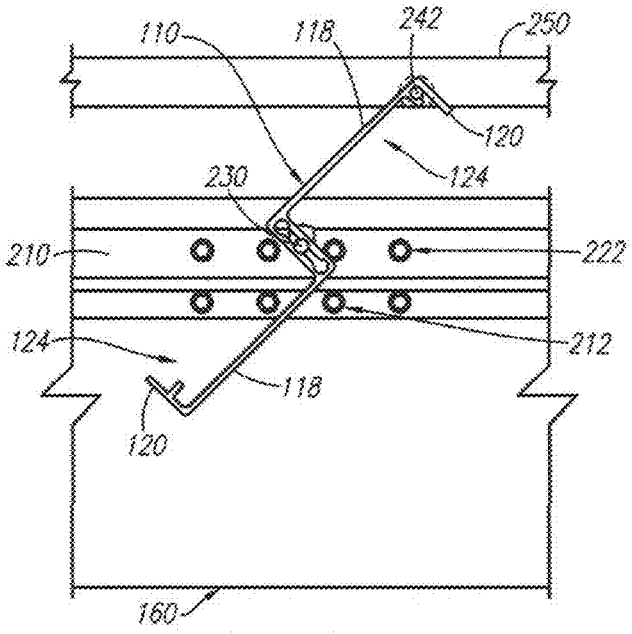
FIG. 4 illustrates aside view of an individual louvered panel coupled to a support member, according to example embodiments.
Figure 5:
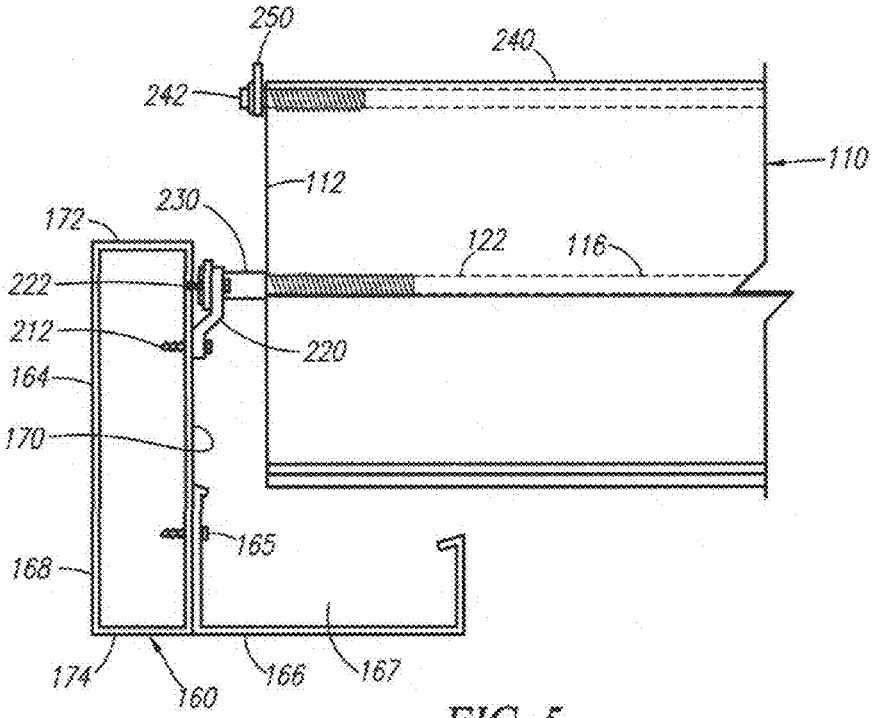
FIG. 5 illustrates a front view of an individual louvered panel coupled to a support member, according to example embodiments.

FIG. 1 illustrates a louvered roof assembly 100, according to example embodiments. Referring to FIGS. 1, 4 and 5 several elongated rectangular louvered roof panels 110 are shown engaged in a closed position. In the closed position, roof panels 110 protect an underlying area from rain or sunlight. Roof panels 110 have a cross-section that is generally S-shaped. Roof panels 110 have opposed ends 112 and 114. Roof panels 110 are formed with a center wall 116. Rails 118 extend perpendicularly away from center wall 116 on opposite sides of center wall 116. Rails 118 each terminate in a flange or lip 120 that extend perpendicularly away from the rail 118. A pair of pivot pin bores 122 are defined in center wall 116 extending perpendicularly into wall 116 from each panel end 112, 114.

The louver roof panels 110 engage one another via their overlapping respective flanges or lips and form channels 124 through which rainwater can flow to reach the gutters 166 that are located below each of the ends 112, 114.

The louvered roof panels 110 are supported for rotational movement by a pair of elongated support members 160 that are arranged perpendicular to the length of panels 110. One support member 160 supports panel ends 112 and another support member 160 supports panel ends 114. Support members 160 have opposite ends 161 and 162. Support members 160 are formed by the combination of a rectangular shaped beam 164 and an attached gutter 166. Beam 164 includes an outer side 168, inner side 170, top side 172 and bottom side 174. Gutter 166 has an internal trough 167 to carry rainwater and is attached to inner side 170 by screws 165. Support members 160 and roof panels 110 can be formed from suitable materials such as aluminum.

Referring to FIGS. 4 and 5, details of the connection of roof panels 110 to support members 160 are shown. An elongated pivot strip 210 is attached to the inner side 170 of beam 164 by screws 212. An angled lock bar 220 is attached to the pivot strip 210 by screws 222. One lock bar 220 is located at each corresponding end of each panel 110. A pivot pin 230 extends through an aperture in the lock bar 220 and has an end that is received by bore 122. Roof panel 110 rotates or pivots about an axis defined by the length of pivot pin 230. A pivot pin 230 is centered about the width of each of the roof panels 110.

Another bore 240 extends perpendicularly into roof panel end 112 at the junction of rail 118 and flange 120. A track pin 242 extends through an aperture in a track bar 250 and has an end that is received by bore 240. Track bar 250 rotates or pivots about an axis defined by the length of track pin 242. Each of the roof panels 110 is attached to the track bar 250 by a track pin 242.

Figure 8A:
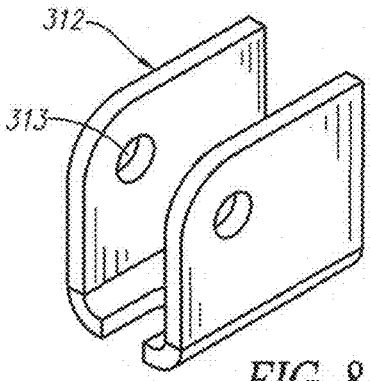
FIG. 8A illustrates a perspective view of an actuator mount, according to example embodiments.

With reference to FIGS. 2(A-C), 3(A-C) and 6, a linear drive mechanism 300 is shown. Linear drive mechanism 300 comprises a linear actuator 310, an actuator mount 312 and an output shaft 316. Actuator mount 312 (FIG. 8A) is mounted to the top side 172 of beam 164 by screws. A linear actuator 310 is attached to actuator mount 312 by a bolt 313. Linear actuator 310 can rotate about bolt 313. Linear actuator 310 is connected to a power source such as a battery or utility power.

Figure 7:
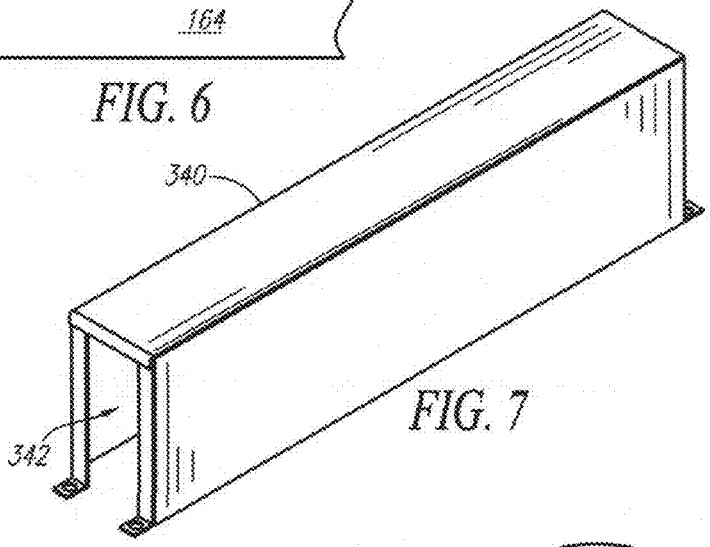
FIG. 7 illustrates a perspective view of a housing, according to example embodiments.

A housing 340 (FIG. 7) has an internal cavity 342. Housing 340 is mounted over linear actuator 310 to protect the actuator and linear drive system from outdoor conditions. Housing 340 is mounted to the topside 172 of beam 164 by screws. Housing 340 protects the linear drive mechanism 300 from the outdoor environment and may be easily removed for maintenance.

Linear actuator 310 has an output shaft 316. Linear actuator 310 can move output shaft 314 in a linear reciprocating manner along an axis generally parallel to the length of support member 160.

Figure 9A:
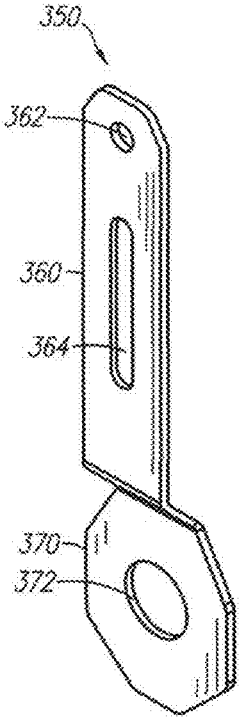
FIG. 9A illustrates a front perspective view of an arm, according to example embodiments.
Figure 9B:
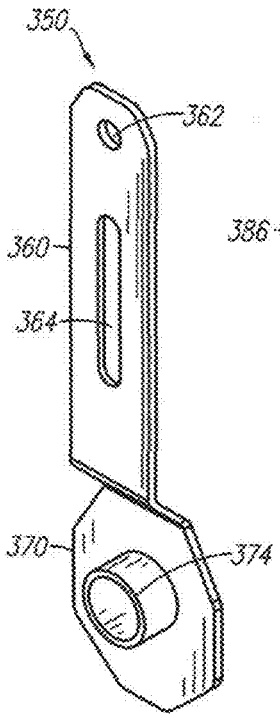
FIG. 9B illustrates a rear perspective view of an arm, according to example embodiments.

Output shaft 316 has a distal end with a thru bore 318. Connecting bolt and bushing 352 extends through an end of arm 350 and through bore 318. Connecting bolt and bushing 352 couples arm 350 to output shaft 316, while allowing rotation between arm 350 and output shaft 316. With additional reference to FIGS. 9A and 9B, arm 350 has an upper rectangular shaped section 360 and a lower hexagonal shaped section 370. Upper section 360 has a hole 362 and an elongated slot 364. Lower section 370 has an aperture 372 that is dimensioned to receive another bushing 374. Bushing 352 is received by hole 362 and is retained to upper section 360.

Figure 8B:
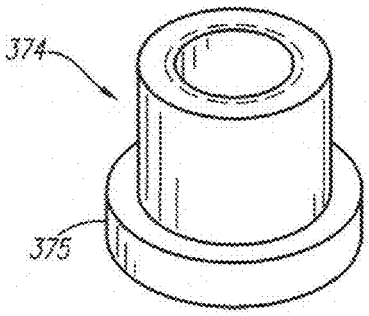
FIG. 8B illustrates a perspective view of a bushing, according to example embodiments.
Figure 10:
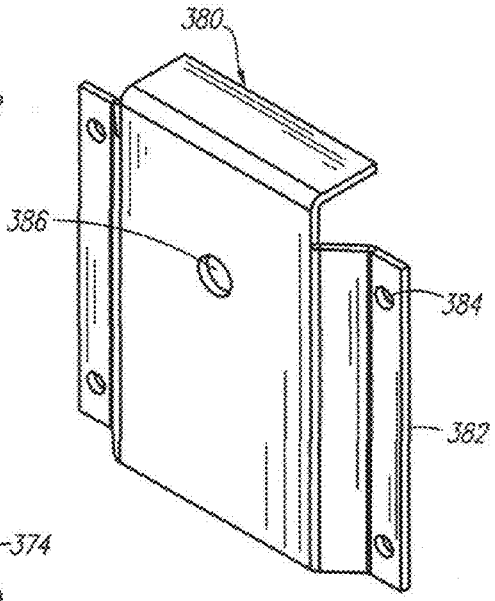
FIG. 10 illustrates a perspective view of a case, according to example embodiments.
Figure 11:
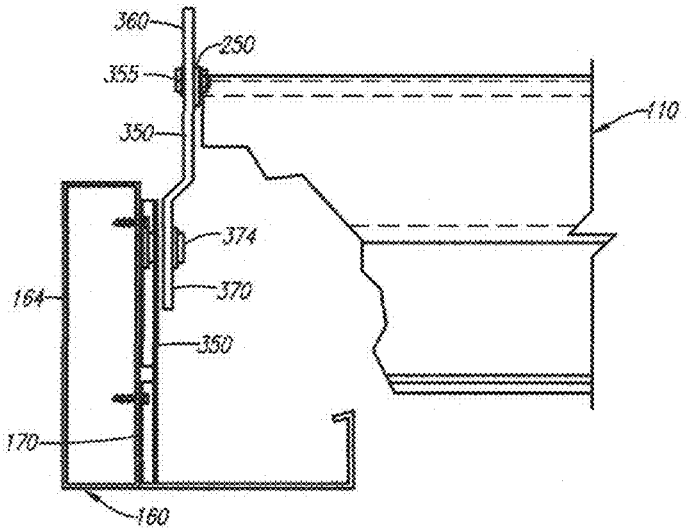
FIG. 11 illustrates a front view of an individual louvered panel coupled to a support member and the arm coupled to the support member and track bar, according to example embodiments.

Referring to FIGS. 8B, 10 and 11, case 380 is mounted to the inner side 170 of beam 166. Case 380 has flanges 382 with apertures 384. Screws extend through apertures 384 are fixed to side 170. Case 380 further has a bushing hole 386. Bushing 374 extends through arm hole 372 and is press fit into bushing hole 386. Bushing head 375 rests against one side of lower section 370. In this manner, arm 350 can rotate about bushing 374. A drive coupling 355 such as a bolt and nut couples the track bar 250 to the arm 350. Drive coupling 355 extends through slot 364 and through a hole in track bar 250. Track bar 250 and arm 350 rotate about drive coupling 355. During operation, drive coupling 355 can slide along the length of slot 364.

Figure 6:
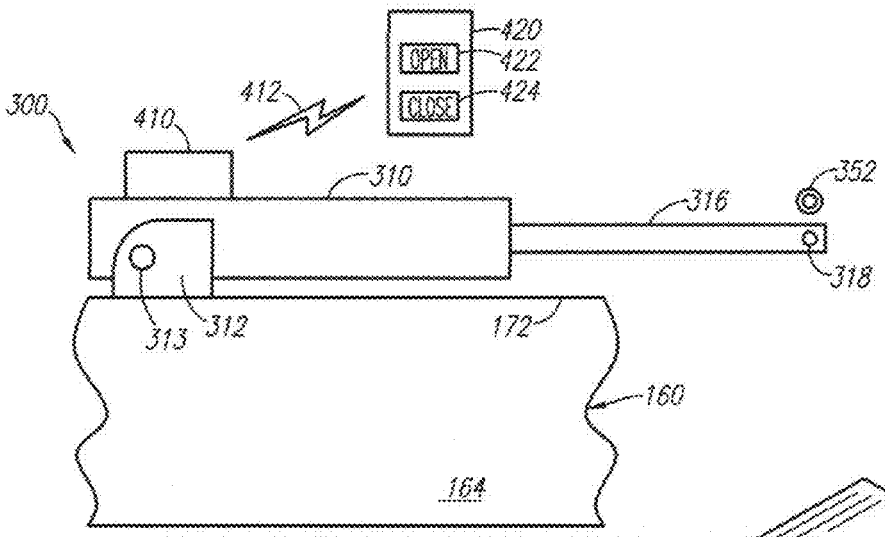
FIG. 6 illustrates a side view of a linear drive assembly, according to example embodiments.

Turning back to FIG. 6, louvered roof assembly 100 further includes a control system 400. Control system 400 can cause linear actuator 310 to open and close roof panels 110. Control system 400 includes a controller 410 and a user input device 420. Controller 410 includes an electronic circuit to drive linear actuator 310 and a transceiver that can receive and send signals such as wired or wireless signals 412. Signals 412 can be RF, IR or wired signals. In one embodiment, user input device 420 is a remote control unit that can send and receive signals such as wireless signals 412 to and from controller 410. User input device 420 has an open button 422 that causes linear actuator 310 to open roof panels 110 and a close button 424 that causes linear actuator 310 to close roof panels 110.

Figure 2A:
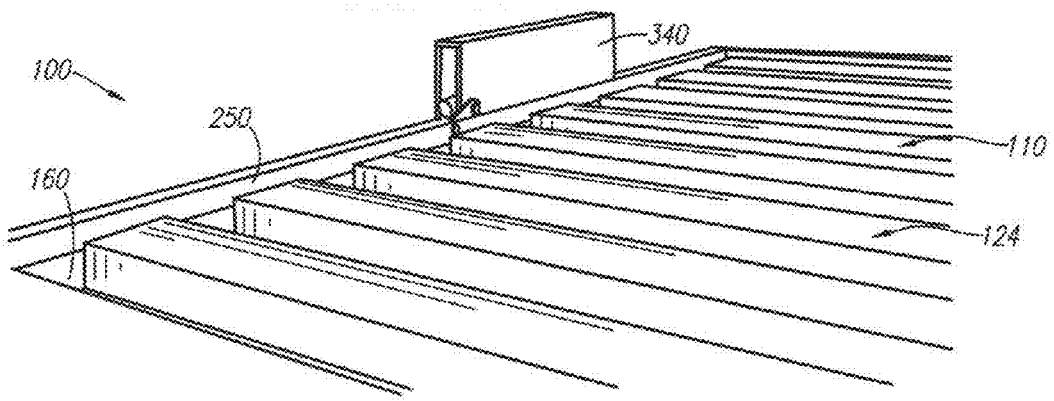
FIG. 2A illustrates an exterior top view of the louvered roof assembly in a closed position, according to example embodiments.

Referring to FIGS. 2(A-C) and 3(A-C), linear drive mechanism 300 can open and close roof panels 110. FIG. 2A illustrates a top view of the louvered roof assembly 100 in a closed position with the individual roof panels 110 in an overlapping arrangement. The track bar 250 runs parallel to the support member 160 and engages each of the louvered panels 110 to provide a secure mounting fixture that connects the track bar 250 with each of the panels 110. As the linear actuator 310 extends, the track bar will shift position and each of the panels 110 will begin to move in unison with one another to open according to the present position of the louver panels.

Figure 2B:
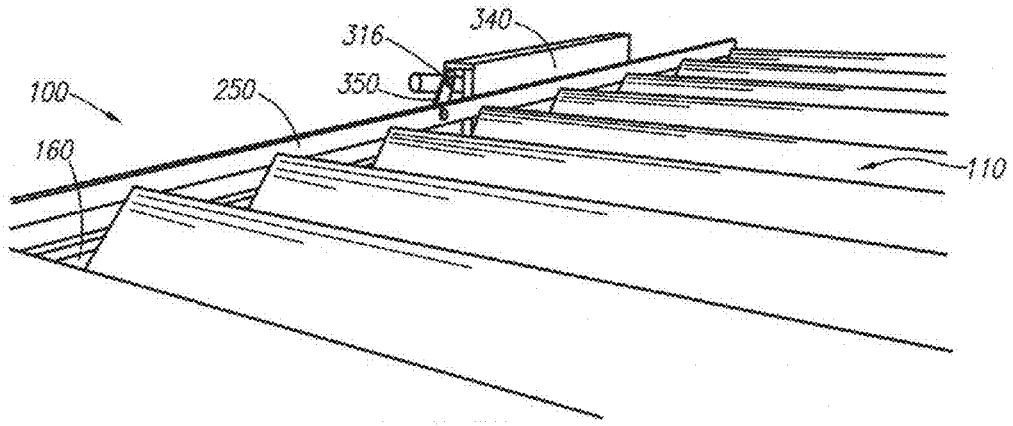
FIG. 2B illustrates an exterior top view of a louvered roof assembly in a partially closed position, according to example embodiments.

FIG. 2B illustrates a top view of the louvered roof assembly 100 in a partially open position. In this illustration, the louver panels 110 have been partially opened and the output shaft 316 has begun to shift outside the housing 340. As the linear actuator 310 extends, output shaft 316 pushes on arm 350 causing arm 350 to rotate about bushing 374. At the same time, the movement of arm 350 causes the track bar 250 to move via the connection of coupling 355. The movement of track bar 250, which is connected to roof panels 110 via track pins 242, causes the louver panels 110 to rotate in unison about pivot pins 230.

Figure 2C:
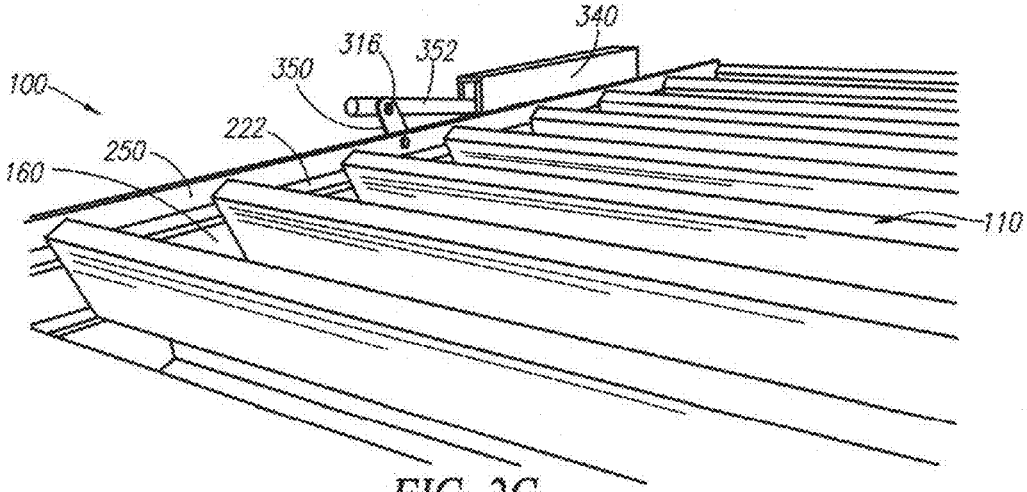
FIG. 2C illustrates an exterior top view of a louvered roof assembly in an open position, according to example embodiments.

FIG. 2C illustrates a top view of the louvered roof assembly 100 in a fully open position. Referring to FIG. 2C, the roof panels 110 are in a full and upright position allowing maximum light to pass through the area between the louver panels 110. The linear actuator 310 and track bar 250 are in a fully extended position with track bar 250 shifted above support member 160.

Figure 3A:
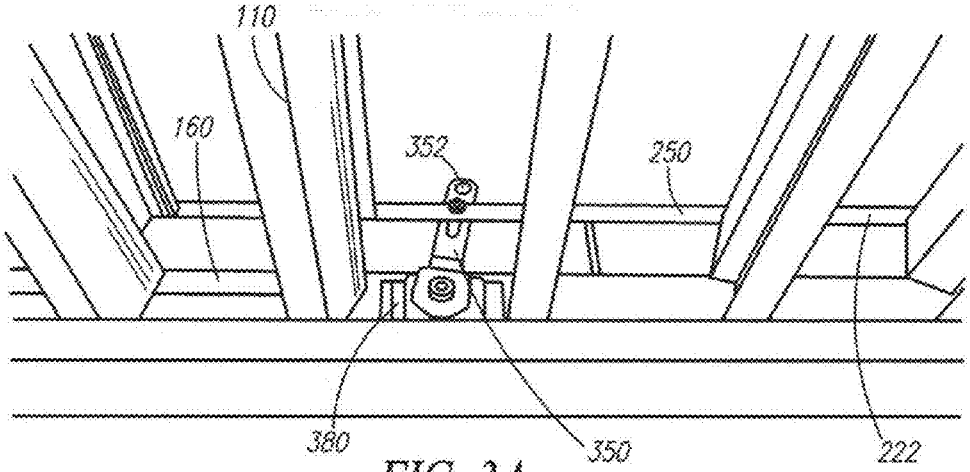
FIG. 3A illustrates an interior view of a louvered roof assembly in an open position, according to example embodiments.

FIG. 3A illustrates a bottom view of the louvered roof assembly 100 in an open position. Referring to FIG. 3A, the track bar 250 and the arm 350 move together to open each of the louver roof panels 110 in unison.

Figure 3B:
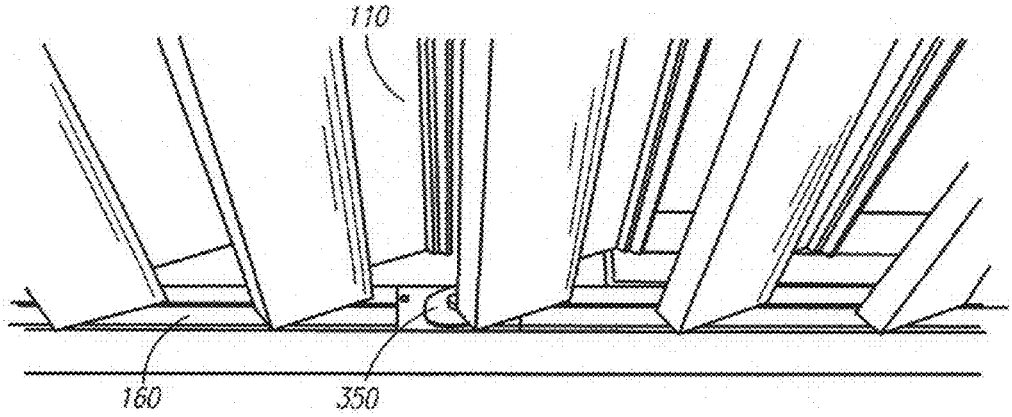
FIG. 3B illustrates an interior view of a louvered roof assembly in a partially opened position, according to example embodiments.
Figure 3C:
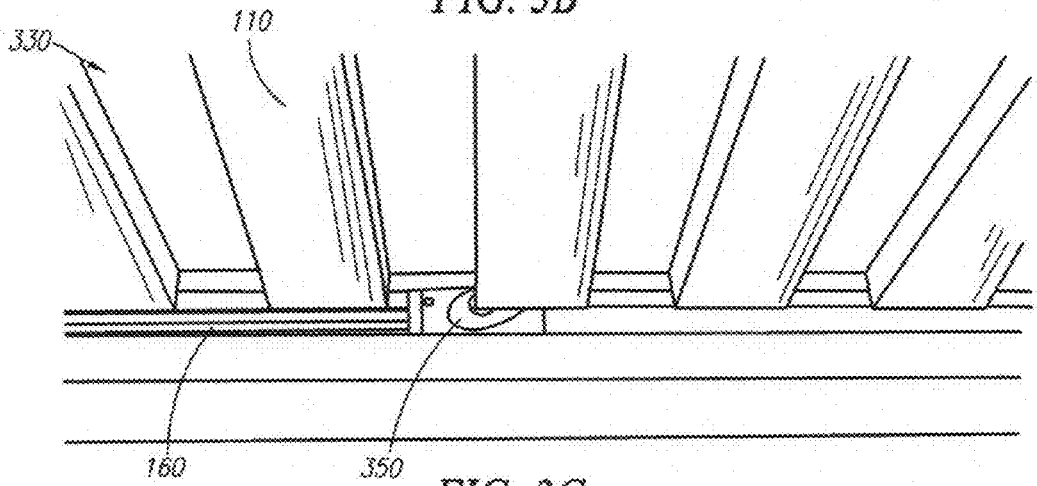
FIG. 3C illustrates an interior view of a louvered roof assembly in a closed position, according to example embodiments.

FIG. 3B illustrates a bottom view of the louvered roof assembly 100 in a partially opened position. The louver roof panels 110 are partially closed. In FIG. 3C, the roof panels 110 are in a fully closed overlapping position such that any rainwater accumulates in channels 124 (FIG. 2A) and is directed to gutter trough 167 (FIG. 5).

Figure 12:
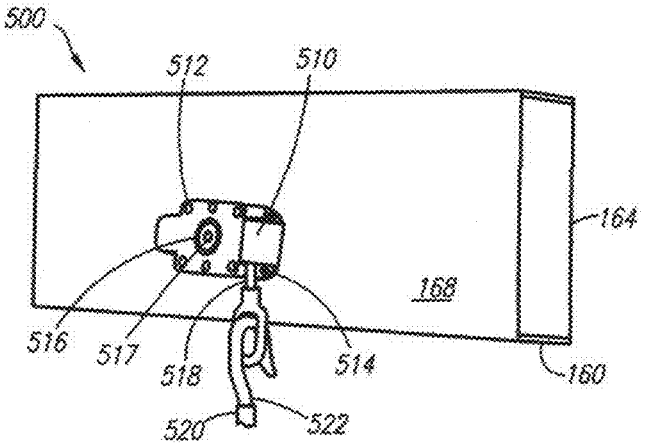
FIG. 12 illustrates a perspective view of a manual drive mechanism, according to example embodiments.
Figure 13:
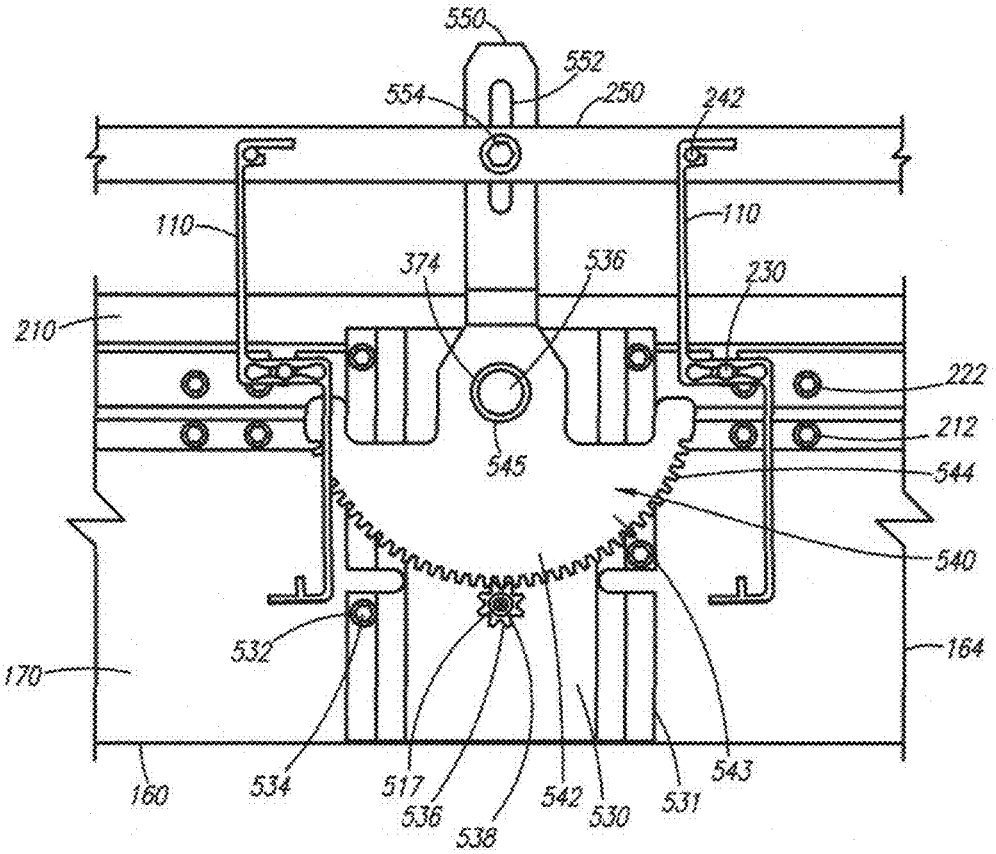
FIG. 13 illustrates a side view of the manual drive mechanism including a driven arm, according to example embodiments.

Turning to FIGS. 12 and 13, according to another example embodiment louvered roof assembly 100 can include a manual drive mechanism 500. Manual drive mechanism 500 replaces the linear drive mechanism 300 previously described. Referring to FIGS. 12 and 13, manual drive mechanism 500 includes a ninety degree gear box 510 that is mounted to the outer side 168 of beam 164 by threaded bolts 512. Gear box 510 has a housing 514 that contains internal gears 516 and a through shaft 517.

A bolt 518 is connected to the internal gears 516 of gear box 510. Bolt 518 extends outwardly from housing 514. The manual drive mechanism 500 includes an elongated pole 520 with a hooked end 522 that engages the bolt 518. A user can rotate pole 520 to turn the bolt 518 thereby causing through shaft 517 to rotate via the internal gears 516 of gear box 510.

FIG. 13 illustrates details of a manually driven arm 540 used in manual drive mechanism 500. Referring to FIG. 13, case 530 is mounted to the inner side 170 of beam 166. Case 530 has flanges 531 with apertures 532. Screws 534 extend through apertures 532 and are fixed to side 170. Case 530 further has a bushing hole 536. Bushing 374 extends through arm hole 545 and is press fit into bushing hole 536. Arm 540 can rotate about bushing 374.

Driving arm 350 has an upper rectangular shaped end section 550 and a lower semi-circular shaped section 542. Upper section 550 has an elongated slot 552. Lower section 370 has teeth 544 formed on the outer circumferential edge of semi-circular shaped gear 543. A drive coupling 554 such as a bolt and nut couples the track bar 250 to the manually driving arm 540.

Drive coupling 554 extends through slot 552 and through a hole in track bar 250. Track bar 250 and arm 540 can pivot about drive coupling 554. During operation, drive coupling 554 can also slide along the length of slot 552. Roof panels 110 rotate or pivot about an axis defined by the length of pivot pin 230. A pivot pin 230 is centered about the width of each of the roof panels 110.

The distal end of shaft 517 faces into gutter trough 167 and has an attached gear 536 with teeth 538. Gear 538 has a much smaller diameter than gear 543 such that many turns of gear 538 are required to move gear 543 a small amount thereby providing force multiplication.

An operator can elect to manually open or close roof panels 110 using manual drive mechanism 500. In order to open or close roof panels 110, the operator rotates pole 520, turning the bolt 518 thereby causing rotation of through shaft 517 via the internal gears 516 of gear box 510. The rotation of through shaft 517 rotates gear 517, which in turn rotates gear 543 causing arm end 550 to move track bar 250 along an axis generally parallel to support members 160. The movement of arm end 550 causes the track bar 250 to move via the connection of coupling 355. The movement of track bar 250, which is connected to roof panels 110 via track pins 242, causes the louver panels 110 to rotate in unison about pivot pins 230 and move towards either an open or closed position depending upon the rotational direction of bolt 518.

Figure 14:
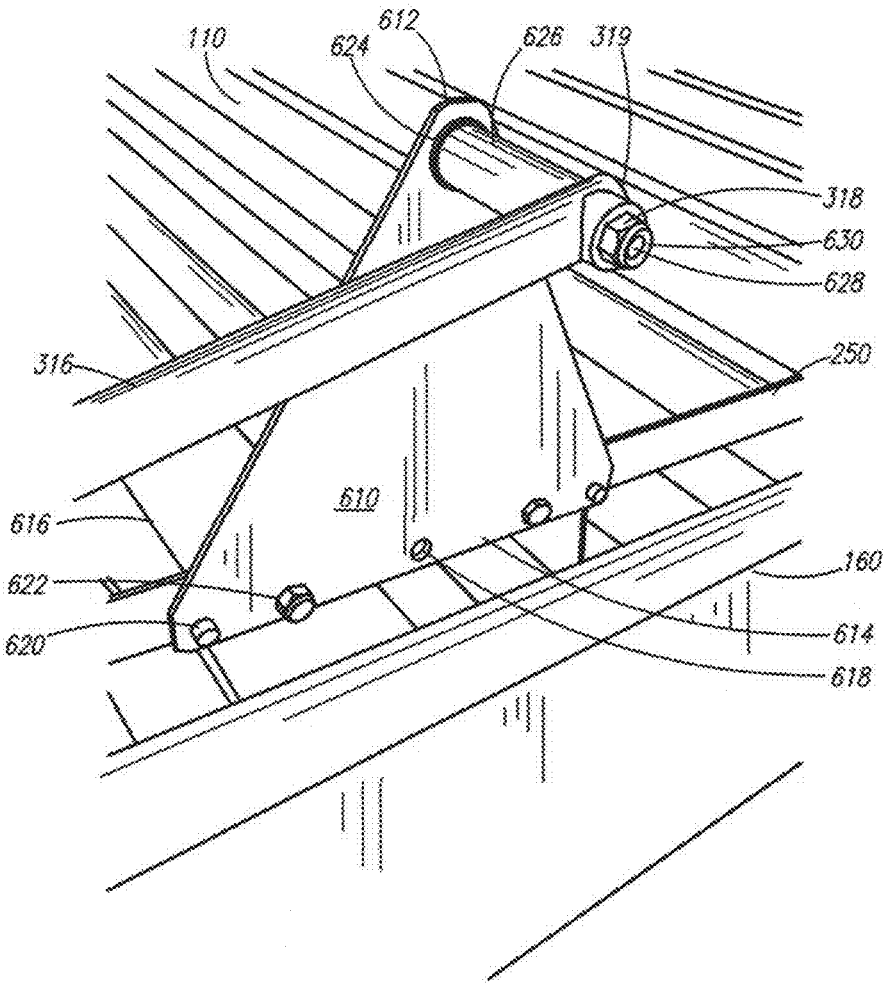
FIG. 14 illustrates a perspective view of an alternative connection between the output shaft and the track bar, according to example embodiments.

FIG. 14 illustrates an alternative embodiment of a connection between the output shaft 316 and the track bar 250. Triangular shaped arm 610 has an apex 612, abase 614 and a center section 616. Several holes 618 are defined in base 614. Fasteners such as bolts 620 extend through holes 618 and through holes (not shown) in track bar 250. Nuts 622 are threaded onto bolts 620. Bolts 620 and nuts 622 retain arm 610 to track bar 250. Arm 610 is rigidly held to track bar 250

An aperture 624 is located in arm 610 toward apex 612. A connecting rod 626 is mounted through aperture 624. Connecting rod 626 has a headed end that is adjacent to arm 610 and a threaded end 628 that extends through output shaft bore 318 at output shaft end 319. A nut 630 is threaded onto end 628 in order to retain connecting rod 626 to output shaft 316. Connecting rod 626, aperture 624 and bore 318 are sized to allow connecting rod 626 to rotate or pivot within aperture 624 and bore 318. Connecting rod 626 can rotate with respect to arm. 620 and can rotate with respect to output shaft 316. Arm 610 provides a connecting link between output shaft 316 and track bar 250 in order to open and close roof panels 110.

It is envisioned that an additional embodiment of a liner drive mechanism may be utilized with the general louvered roof assembly description provided above. For example, in FIG. 15A through FIG. 15C and FIG. 16A through FIG. 16E, a louvered roof assembly 700 is depicted having a support frame comprising beams 702 and gutters 704. The beams 702 are mutually coupled to one another, and the gutters 704 are mutually coupled to one another. In the embodiment depicted, the mutually coupling of beams with beams and gutters with gutters forms a substantially orthogonal outline of the support frame, with a plurality of louvered panels 706 disposed within and between the support frame. A motor 708 for actuating movement of a linear drive mechanism 710 is mounted within the beam 702 and gutter 704 along one end of the assembly 700. In one embodiment, the motor 708 pushes or pulls a lower pin assembly 714 along a drive beam slot 712 housing the lower pin assembly 714, thereby allowing the louvered panels to retract or expand according to user command with the louvered panels rotating and stacking or unstacking.

Figure 15A:
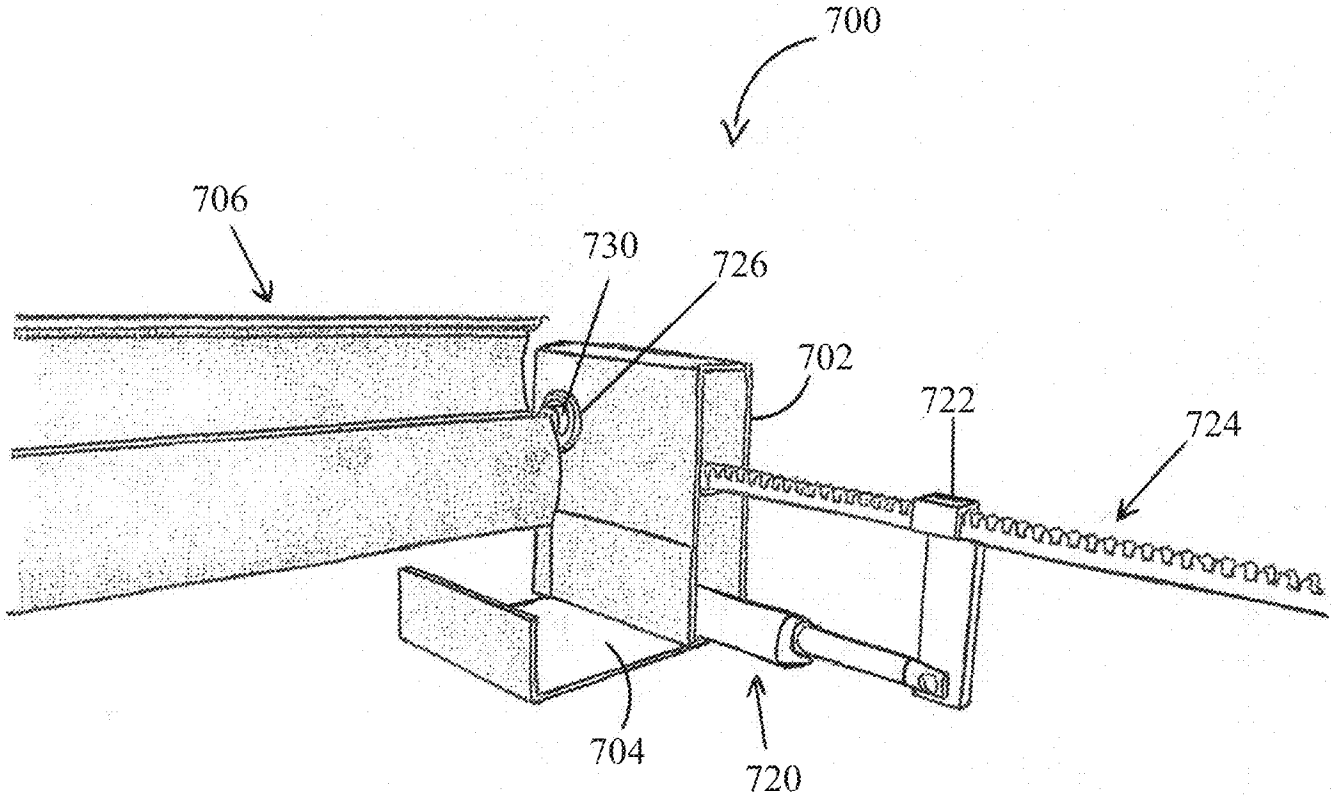
FIG. 15A illustrates a rear perspective of an embodiment of a linear drive mechanism.
Figure 15B:
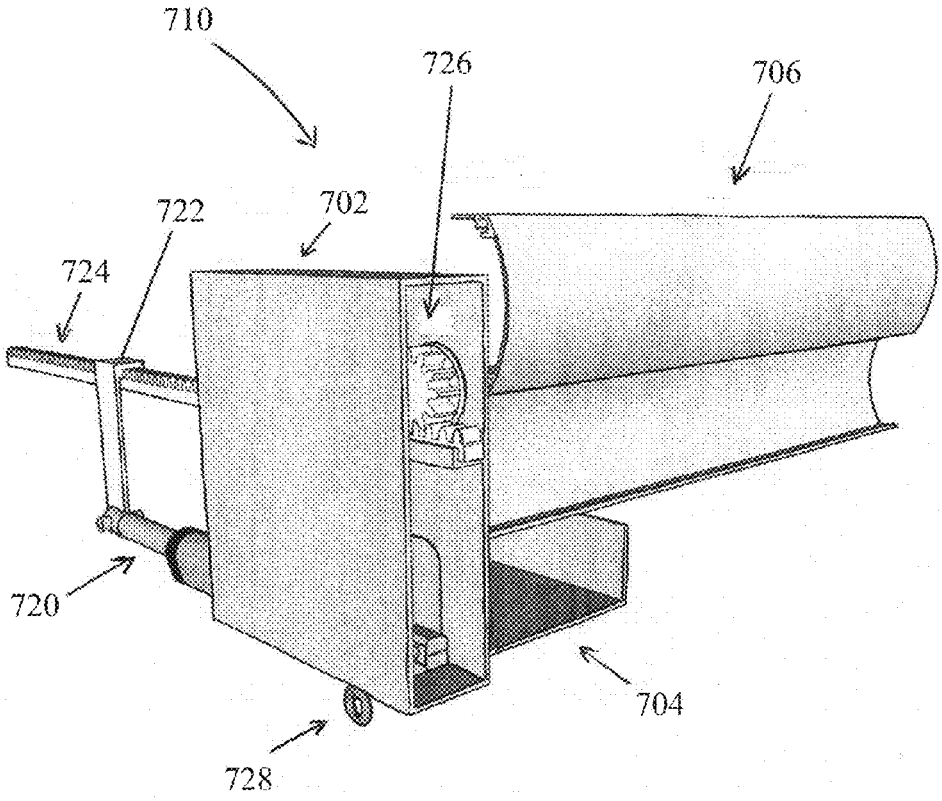
FIG. 15B illustrates a front perspective of an embodiment of a linear drive mechanism as depicted in FIG. 15A.
Figure 15C:
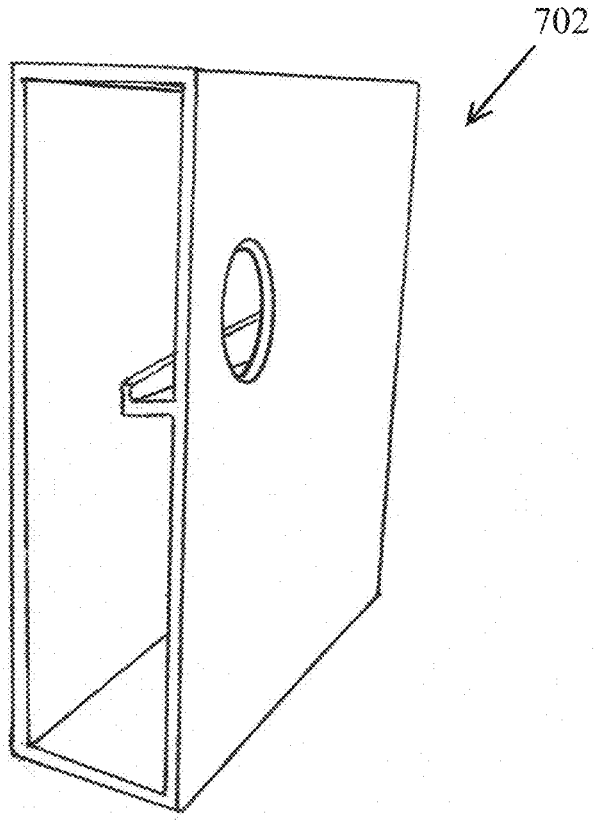
FIG. 15C illustrates a housing for an embodiment of a linear drive mechanism as depicted in FIG. 15A and FIG. 15B.
Figure 16A:
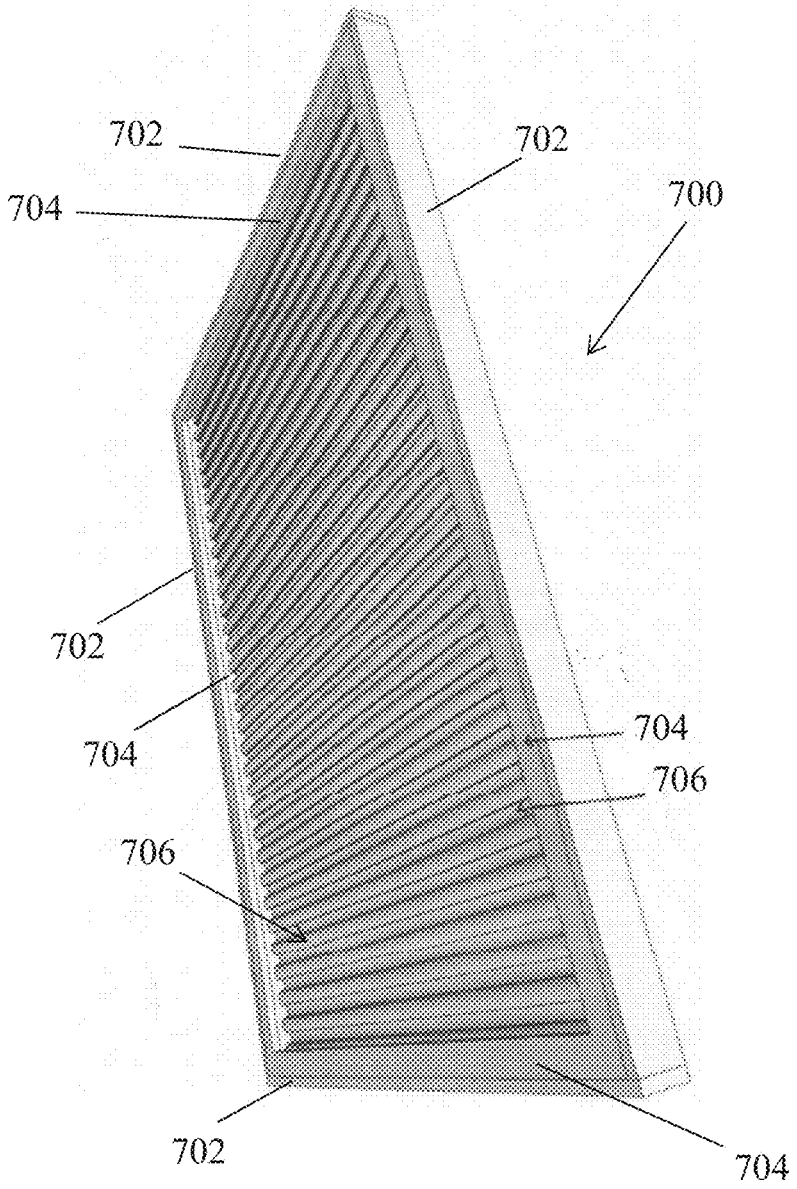
FIG. 16A illustrates a retractable louvered roof in a closed positon.
Figure 16B:
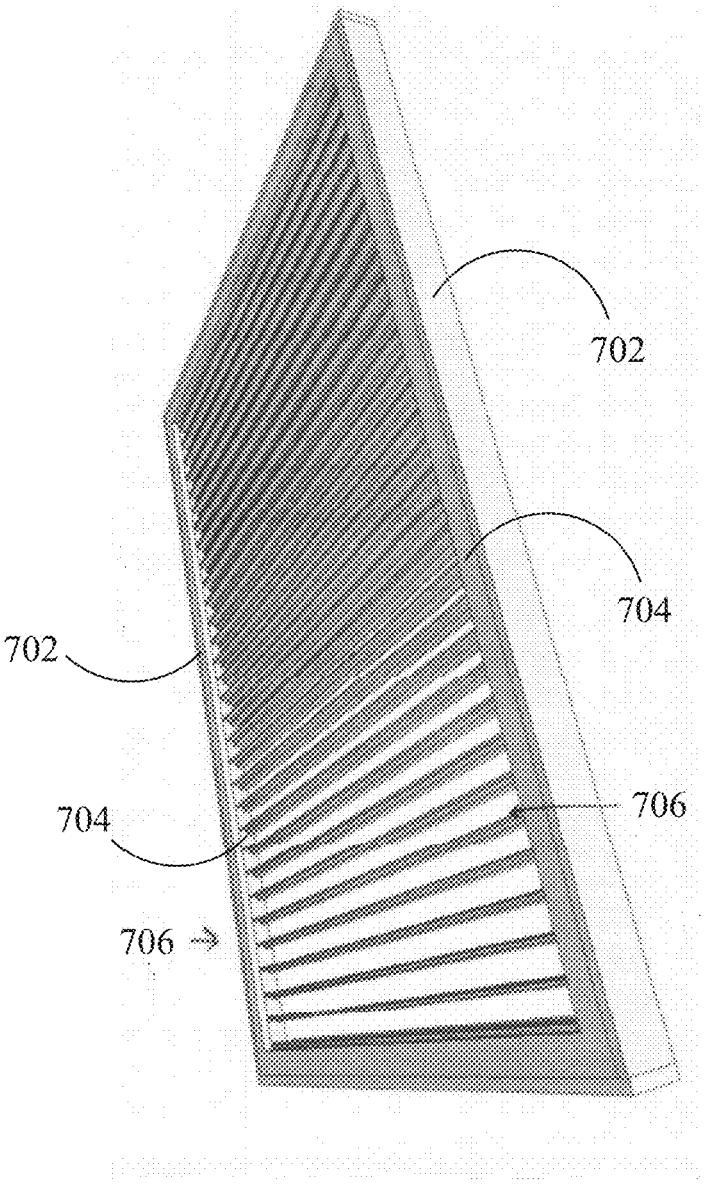
FIG. 16B illustrates a retractable louvered roof with the individual louvered panels rotated approximately 90 degrees.
Figure 16C:
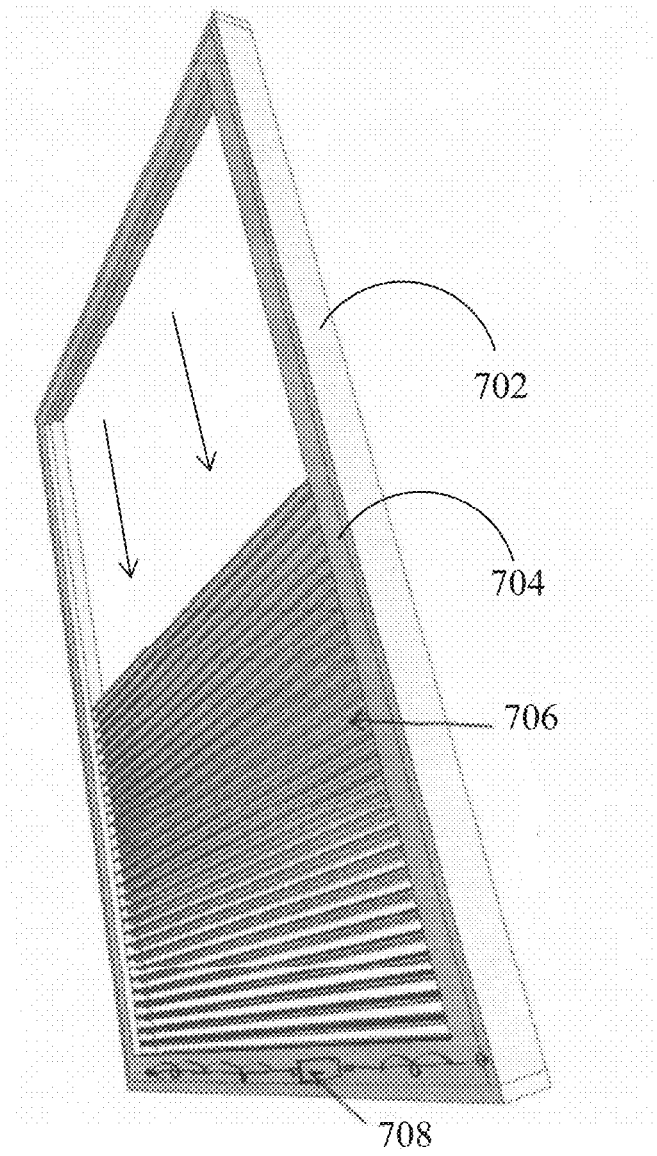
FIG. 16C illustrates a retractable louvered roof in a partially opened position.
Figure 16D:
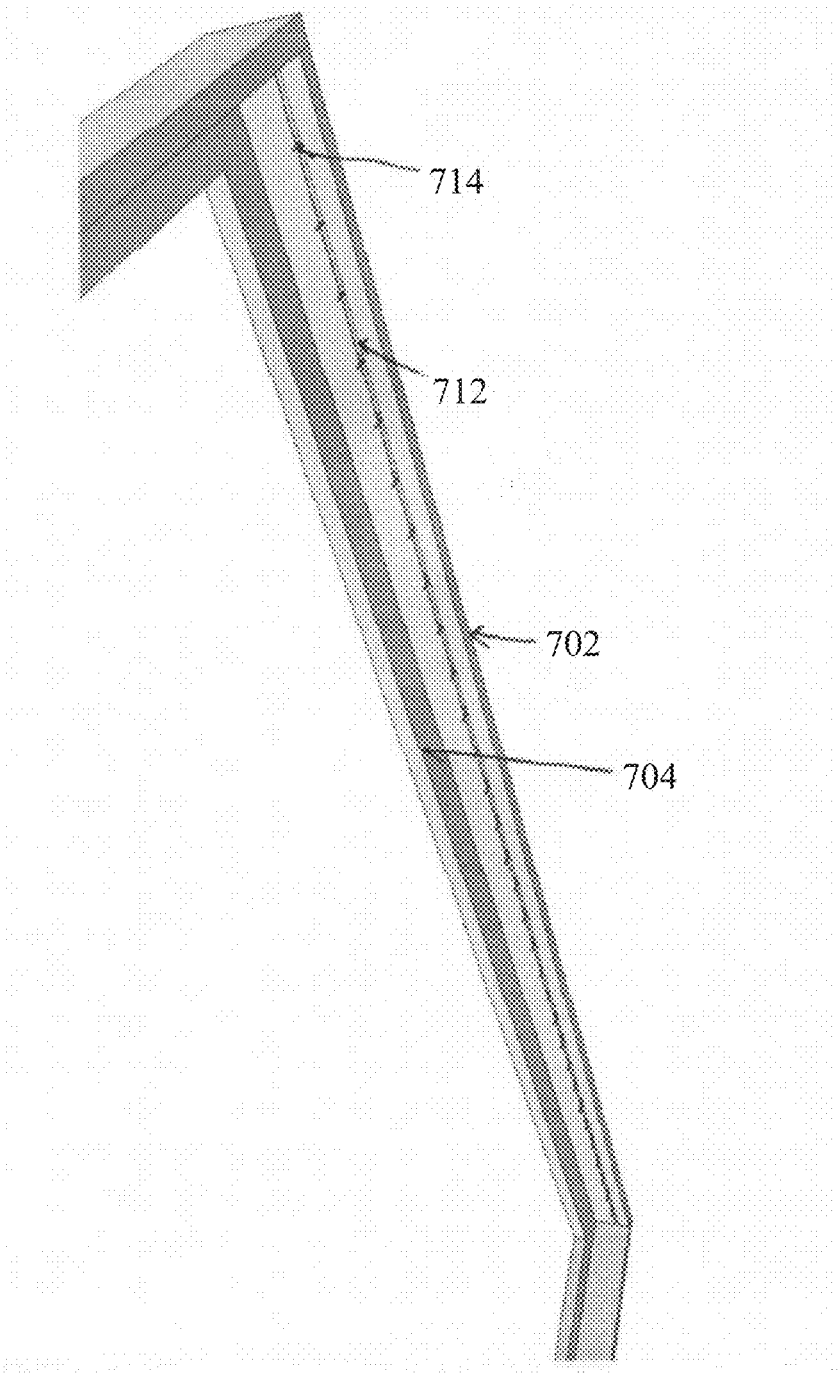
FIG. 16D illustrates pins for retracting the louvered roof.
Figure 16E:
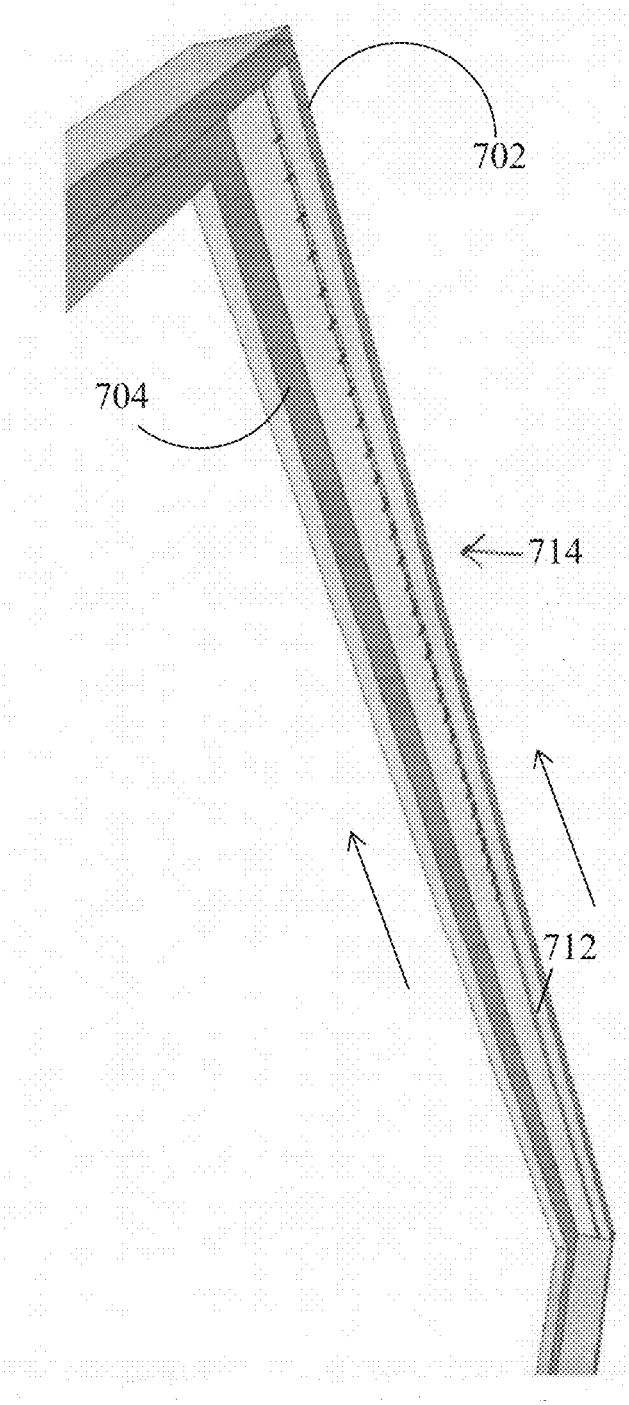
FIG. 16E illustrates pins completely retracted.

In one embodiment of the linear drive mechanism 710, the motor and individual elements of the mechanism are encased within the beam 702 of the support frame. As depicted in FIGS. 15A and 15B, the mechanism 710 includes a linear actuator arm 720 coupled to a drive rack bracket 722 that rides along a drive rack 724. The drive rack 724 has teeth complementary to the toothed-gear 726 mounted within the beam 702 and coupled with the louvered panel 706 end. The louvered panel 706 end has a lock spacer 730 disposed between the end and the gear plug 726. As the motor urges retraction or expansion of the louvered panels 706 within the support frame, the actuator arm 720 lengthens or shortens, causing the drive rack bracket 722 to move forward or rearward along the drive rack 724, and urging the gear 726 to turn either to flatten the louvered panels 706 into an expanded (and sun or weather-blocking) position, or to rotate approximately 90 degrees in preparation for movement along the beams and gutters. A manual override 728 is provided to allow a user to quickly stop movement as required. As is depicted in FIG. 15C, the beam 702 encases a chute 730 upon which the drive rack 724 moves along.

Figure 17A:
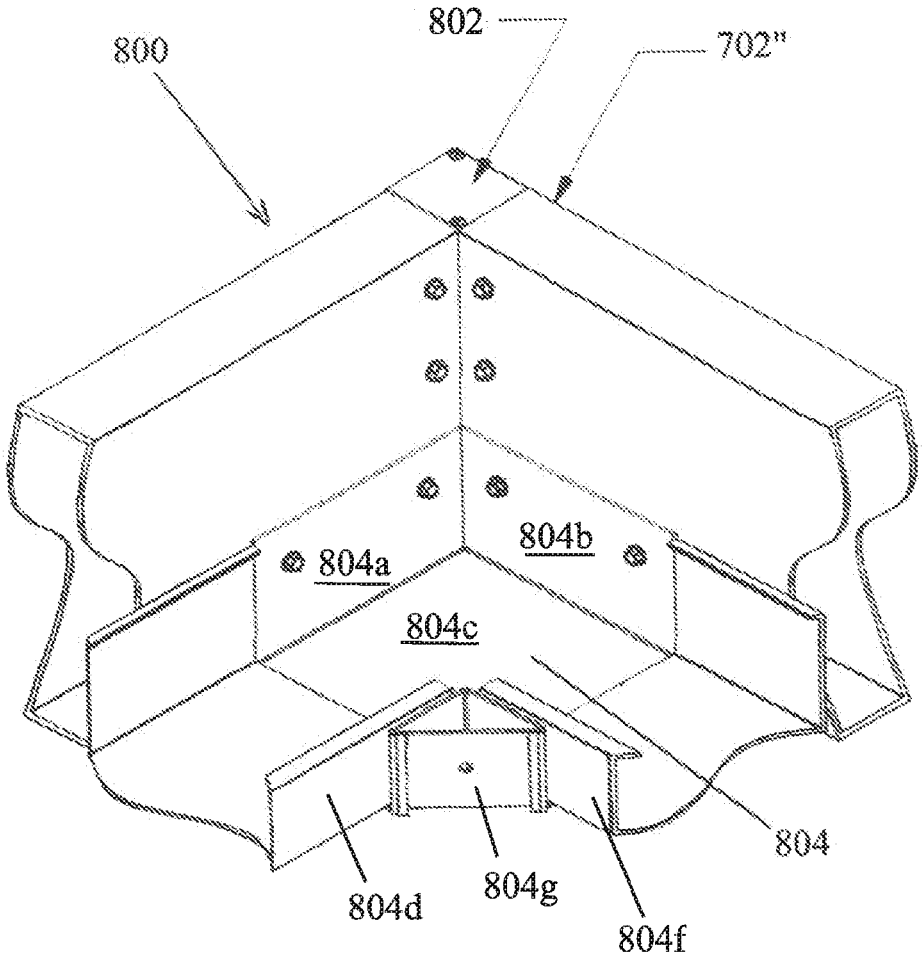
FIG. 17A illustrates a perspective view of corner connectors for the beams and the gutters.
Figure 17B:
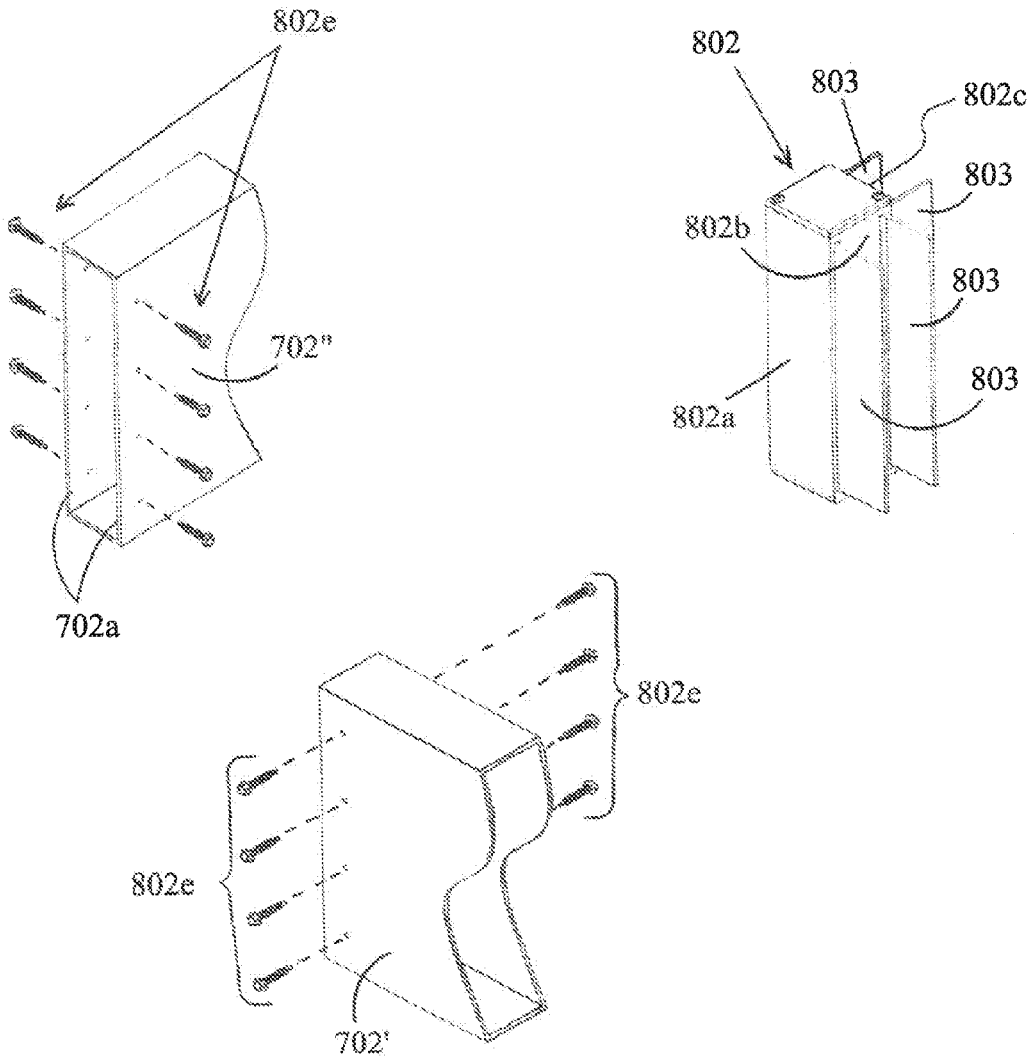
FIG. 17B illustrates a perspective view of the beam corner connectors as depicted in FIG. 17A.
Figure 17C:
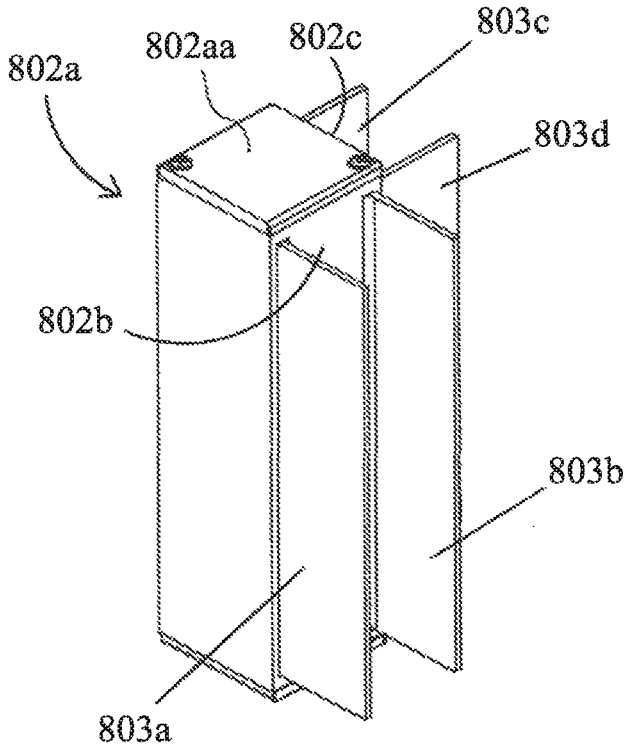
FIG. 17C is a top right perspective view of a beam corner connector, in accordance to one embodiment of the present invention.
Figure 17D:
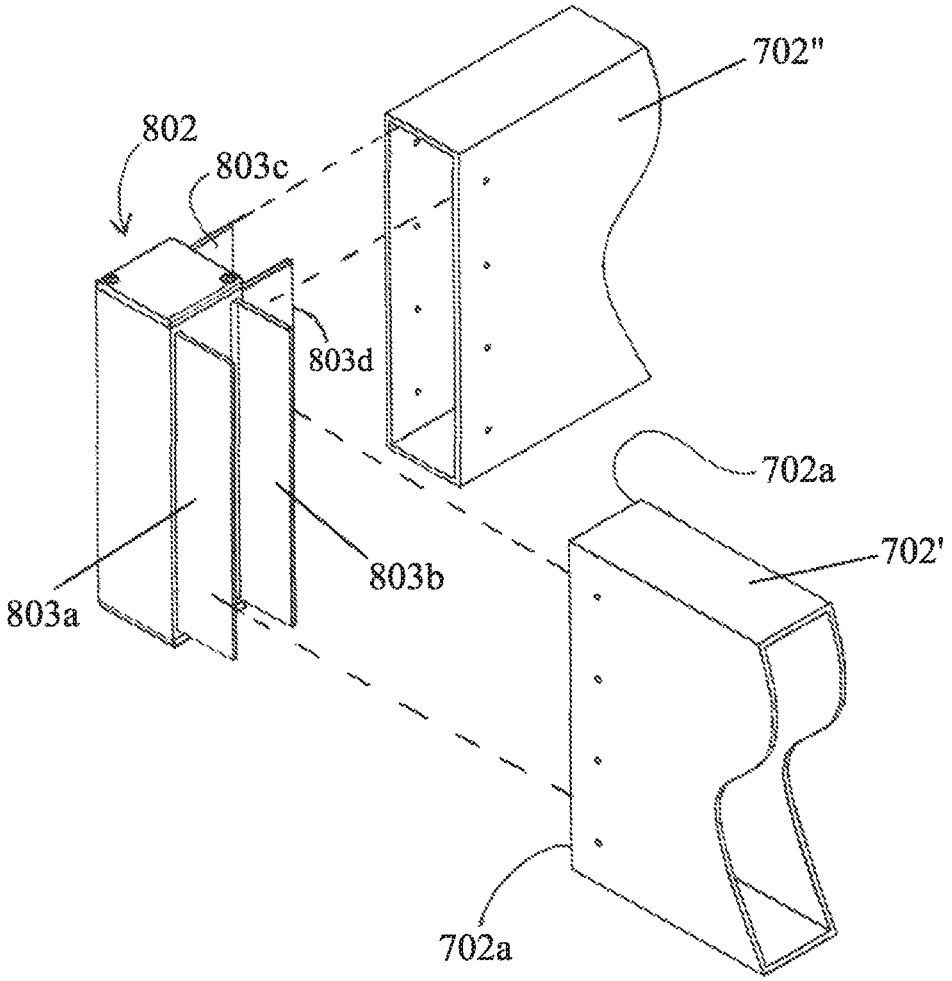
FIG. 17D is an exploded perspective view of the corner connector assembly, in accordance to one embodiment of the present invention.

As depicted in FIGS. 17A-17D, a corner connector assembly 800 having a beam corner connector 802 and a gutter corner connector 804 may be provided and utilized for quickly assembling straight-cut beams 702 and gutters 704. The beam corner connector 802 comprises a pillar 802*a* having a plurality of inserts 803. The pillar 802*a* is capped with a top plate 802*aa* mounted thereatop. The pillar 802*a* comprises adjacent faces 802*b* and 802*c* that accommodate the inserts 803, the inserts 803 receive the straight-cut edges 702*a* of the beams 702 in a slidably engaging manner, thereby coupling the beams 702 to the beam corner connector 802. As depicted in FIG. 17D, inserts 803*a* and 803*b* are inserted between the straight-cut edges 702*a* of a first beam 702', and positioned contiguous to face 802*b* and adjacent face 802*c*, and inserts 803*c* and 803*d* are inserted between the straight-cut edges 702*a* of a second beam 702", and positioned contiguous to face 802*c* and adjacent face 802*b*. The beams 702' and 702" are mechanically coupled to the inserts 803 via fasteners 802*e*.

The gutter corner connector 804 comprises a pair of upstanding walls 804*a* and 804*b* and a floor 804*c*. The walls 804*a* and 804*b* are mutually joined at a corner and the floor 804*c* is joined with the lower edges of the walls 804*a* and 804*b*. A triangular-shaped corner brace 804*d* is used to secure the gutters 704' and 704" at the outer edges of the gutter corner connector 804. The straight-cut edge of each gutter 704' and 704" may be abutted with the respective edges of the walls 804*a* and 804*b* and floor 804*c*, with the corner brace 804*d* positioned in the orthogonal corner formed between the converging gutters 704' and 704", utilizing mechanical fasteners 804*e*. The outer face 804*f* of the corner brace 804*d* may include a decorative or ornamental face plate 804*g* that is removable and replaceable with a variety of customized monogram, lettering, logos, and the like.

It is envisioned that the various embodiments, as separately disclosed, are interchangeable in various aspects, so that elements of one embodiment may be incorporated into one or more of the other embodiments, and that specific positioning of individual elements may necessitate other arrangements not specifically disclosed to accommodate performance requirements or spatial considerations.

It is to be understood that the embodiments and claims are not limited in its application to the details of construction and arrangement of the components set forth in the description and illustrated in the drawings. Rather, the description and the drawings provide examples of the embodiments envisioned, but the claims are limited to the specific embodiments. The embodiments and claims disclosed herein are further capable of other embodiments and of being practiced and carried out in various ways. Also, it is to be understood that the phraseology and terminology employed herein are for the purposes of description and should not be regarded as limiting the claims.

Accordingly, those skilled in the art will appreciate that the conception upon which the application and claims are based may be readily utilized as a basis for the design of other structures, methods, and systems for carrying out the several purposes of the embodiments and claims presented in this application. It is important, therefore, that the claims be regarded as including such equivalent constructions.

Furthermore, the purpose of the foregoing Abstract is to enable the U.S. Patent and Trademark Office and the public generally, and especially including the practitioners in the art who are not familiar with patent and legal terms or phraseology, to determine quickly from a cursory inspection the nature and essence of the technical disclosure of the application. The Abstract is neither intended to define the claims of the application, nor is it intended to be limiting to the scope of the claims in any way. It is intended that the application is defined by the claims appended hereto.

What is claimed is:

1. A louvered roof assembly comprising:

a support frame comprising a plurality of beams including a first beam and a second beam, and a plurality of gutters, the beams each having straight-cut edges, the beams and gutters mutually adjacent so that the beams form an exterior portion of the support frame and the gutters form an interior portion of the support frame;

a plurality of panels pivotally mounted between the plurality of beams of the support frame, each of the plurality of panels rotatable about a respective axis, each of the plurality of panels having a first end and a second end;

a linear drive mechanism having a motor and mounted to the support frame and within at least one of the beams, an actuator arm configured to move in conjunction with a drive rack and a gear, thereby causing each of the panels to rotate about their respective axis;

and a corner connector assembly comprising a beam corner connector, wherein the beam corner connector comprises:

a connector pillar;

a first connector face and a second connector face, the connector faces mutually adjacent along the perimeter of the pillar; and a plurality of inserts including a first pair of inserts and a second pair of inserts, wherein the first pair of inserts are aligned along the first connector face and the second pair of inserts are aligned along the second connector face, the first pair of inserts receives the straight-cut edges of the first beam in a slidably engaging manner, the second pair of inserts receives the straight-cut edges of the second beam, thereby coupling the first and second beams to the beam corner connector, and wherein the beams are mechanically secured to the first pair of inserts and the second pair of inserts via fasteners.

2. The louvered roof assembly of claim 1, further comprising a drive slot formed within one of the beams of the support frame housing a plurality of pins for urging the panels forward and rearward.

3. The louvered roof assembly of claim 2, wherein the pins are secured to the panels.

4. The louvered roof assembly of claim 1, wherein the actuator arm is coupled to the drive rack by a drive rack bracket, the bracket engaging a plurality of teeth formed on the drive rack.

5. The louvered roof assembly of claim 1, further comprising a gutter corner connector.

6. The louvered roof assembly of claim 5, wherein the gutter corner connector comprises a pair of upstanding walls mutually adjacent and a floor coupled to a lower edge of the upstanding walls.

7. The louvered roof assembly of claim 6, further comprising a corner brace positioned orthogonal to the floor of the gutter corner connector.

8. The louvered roof assembly of claim 7, wherein the corner brace comprises a face comprising a removable face plate.

9. The louvered roof assembly of claim 8, wherein the the removable face plate is ornamented with at least one of a customized monogram, lettering, and a logo.

* * * * *